US006755147B2

(12) United States Patent
Katz

(10) Patent No.: US 6,755,147 B2
(45) Date of Patent: Jun. 29, 2004

(54) UNDERWATER SIGNALLING DEVICES

(76) Inventor: Peter Katz, 1 Kenneth Road, Manly Vale, NSW (AU), 2093

( * ) Notice: Subject to any disclaimer, the term of this patent is extended or adjusted under 35 U.S.C. 154(b) by 0 days.

(21) Appl. No.: 10/149,040

(22) PCT Filed: Dec. 8, 2000

(86) PCT No.: PCT/AU00/01523

§ 371 (c)(1),
(2), (4) Date: Nov. 21, 2002

(87) PCT Pub. No.: WO01/41943

PCT Pub. Date: Jun. 14, 2001

(65) Prior Publication Data

US 2003/0121466 A1 Jul. 3, 2003

(30) Foreign Application Priority Data

Dec. 8, 1999 (AU) ..... PQ4515

(51) Int. Cl.[7] ..... G10K 9/04
(52) U.S. Cl. ..... 116/27; 116/142 FP; 405/186
(58) Field of Search ..... 116/26, 27, 142 FP, 116/139, 137 R, 266; 441/89; 251/321; 137/557; 367/144; 181/113, 118; 405/186

(56) References Cited

U.S. PATENT DOCUMENTS 3,638,752 A * 2/1972 Wakefield ..... 181/120
3,811,400 A * 5/1974 Smilg ..... 116/70
4,064,899 A * 12/1977 Lehmann ..... 137/269
4,095,667 A 6/1978 Mahig et al. ..... 181/120
4,284,164 A 8/1981 Airhart ..... 181/117
4,852,510 A 8/1989 Joseph, Jr. et al. ..... 116/140
4,998,499 A 3/1991 Nordbeck ..... 116/142 FP
5,022,790 A * 6/1991 Stevenson ..... 405/186
5,040,477 A * 8/1991 Schiffmacher ..... 116/70
5,106,236 A * 4/1992 Hancock et al. ..... 405/186
5,302,055 A * 4/1994 Johnston ..... 405/186
5,788,415 A 8/1998 Chen ..... 405/186
5,951,205 A * 9/1999 Chen ..... 405/186

* cited by examiner

*Primary Examiner*—Christopher W. Fulton
*Assistant Examiner*—R. Alexander Smith
(74) *Attorney, Agent, or Firm*—Greenberg Traurig

(57) ABSTRACT

A signalling device (10) adapted to make a percussive sound, for example, under water. The signalling device (10) may be attached to a pressurized fluid source, such as a diver's compressed air supply, the device (10) including: a housing (12) having a passageway (22), at least in part, for communication with the fluid source; a valve member (34) located in the passageway (22) and movable between a closed position in which it substantially blocks the passageway (22), and an open position in which fluid may flow through the passageway (22); biasing means (42), such as a spring, biasing the valve member (34) towards the closed position, wherein the valve member (34) reciprocates between the open and closed positions when a pressure difference above a set value exists on either of the valve member (34) to produce a perscussive sound.

17 Claims, 2 Drawing Sheets

UNDERWATER SIGNALLING DEVICES

TECHNICAL FIELD

This invention relates to signalling devices and more particularly to signalling devices used for underwater signalling or warning.

BACKGROUND ART

Various devices exist for underwater sound generation. Generally, these devices are connected to a diver's compressed air supply and, when activated, the compressed air drives a piston backwards and forwards, usually by way of suitable valve arrangements. These valve arrangements may be separate from the reciprocating piston or may be incorporated into the piston. However, which ever valve arrangement is utilised, this adds cost and complexity to the device.

For example, in Johnston. U.S. Pat. No. 5,305,055, there is described a signalling device 10. The signalling device 10 comprises a main body part 11 with a bore for housing a piston 40 shown in FIG. 6. The piston 40 is adapted to reciprocate between a diaphragm 22 at one end of the bore which alternately controls the flow of compressed air to either end of the piston 40. The operation of the flapper valve 36 is separate from the piston 40.

DISCLOSURE OF THE INVENTION

The present invention does away with a separate valve arrangement and instead, in a preferred form, merely utilises a spring loaded valve. The valve reciprocates when pressurised air is supplied to one side and so generates sound.

In one broad form the invention provides a signalling device for attachment to a pressurised fluid source, the device including:

- a housing having a passageway, at least in part, for communication with the fluid source;
- a valve member located in the passageway and movable between a closed position in which it substantially blocks the passageway, and an open position in which fluid may flow through the passageway;
- biasing means biasing the valve member towards the closed position, wherein the valve member reciprocates between the open and closed
- positions when a pressure difference above a set value exists on either side of the valve to produce a percussive sound.

The fluid source may be any fluid supply held under pressure. The fluid source may be a diver's compressed air supply. The air supply may include one or more air tanks of the type commonly used in scuba diving and one or more air hoses extending from the air supply to a mouth piece.

In use the signalling device may be positioned on the air hose intermediate the air tank and the mouth piece. The signalling device may alternatively be located in use on a separate pipe, tube, hose or the like in communication with the air supply. Preferably the signalling device is located around about the waist level of the operator to enable easy accessibility.

The housing may be integrally formed or may consist of a two or more discretely formed components adapted to be assembled to form the housing. The housing or the components therefor may be formed by moulding. Where the housing or one or more of the components are made of metal these may be cast in a mould. Where the housing or components are made of one or plastics materials, these may be formed by injection moulding.

The passageway formed within the housing may include a bore extending through the housing between an upstream opening and a downstream opening. The passageway may comprise a continuous line-of-sight bore extending from the upstream opening to the downstream opening and only interrupted by the valve member. The passageway may be of a consistent diameter.

The passageway may comprise one or more axes. The passageway may include two or more sections in the form of chambers. The chambers may be of varying shape and diameter. Preferably the section of the passageway to be blocked by the valve member is a circular shoulder against which the valve member is adapted to rest in the closed position. In use the upstream opening may be in communication with the fluid source by means of suitable fluid-tight connections. The downstream opening may be in communication with the environment immediately surrounding the signalling device.

The valve member may comprise any of a range of shapes provided it is configured to substantially block the passageway and accordingly the shape of the valve member may be configured to be of a complementary shape relative to the section of the passageway to be blocked.

The valve member may include a head portion and a rod or shaft portion. The head and the rod portions may be integrally formed. The head and rod portions may be formed separately. The rod portion may be adapted to slidingly engage the head portion whereby to form a further percussive means.

Preferably the head and rod portion are rigidly fixed to one another or formed integrally. The head portion may be a flat disc. The rod portion may be a solid cylindrical shape. The rod portion may extend axially from the head portion.

The valve member may be formed by casting in the case of the valve member being made of metal, or injection moulding where the valve member is made of a suitable plastic material. Where the valve member is made of plastic material, the material is preferably hard whereby to display percussive characteristics when striking another hard surface.

The valve member in the closed position may be adapted to block the passageway by abutment against a valve seat. Preferably the valve member is seated in a movable valve seat when in the closed position, and when in said open position the valve seat may move between two positions. The valve seat may be adapted to produce percussive sound upon arriving at each of the two positions. The valve seat may be retained within a bore forming part of the passageway by means of internal retaining means such as shoulders within the bore. The valve seat may be adapted to strike against the retaining means to cause a percussive sound.

The valve member is preferably located axially within the passageway and at its open position contacts a portion of the housing. This portion of the housing may include a body which may be retained within the housing. The body may be in contact with the immediate environment surrounding the signalling device.

The body may include a second bore adapted to slidingly receive the rod portion. The body portion may be located in the passageway. The body may be suspended axially within the passageway. The body may be connected to the rest of the housing by one or more radiating bridges. The body may be located axially within a chamber defined by the housing and forming part of the passageway. The chamber may contain the valve member and the body.

Preferably the biasing means comprises a first biasing member which always biases the valve member towards the closed position and a second biased member which only engages the valve member when the valve member is not in the closed position. Preferably the second biased member includes a sound generating or percussive member biased to contact against the housing.

The percussive member may be biased by a second biasing means towards the valve member. The percussive member may be a adapted to travel within the housing. More particularly, the percussive member may be a adapted to travel within the body. The percussive member may be a adapted to travel axially relative to the passageway within the housing or, more particularly, the body. The second biasing means may be housed within the body. The valve member may be adapted to strike the percussive member when moving to the open position.

The percussive member may be adapted to strike the housing when the valve member returns towards the closed position upon the urging of the percussive member towards the valve member by the second biasing means. The portion of the housing so struck preferably is the body.

The signalling device may include control means for controlling the flow of fluid through the passageway from the fluid source. The control means may include any suitable shut off or valve means. The control means may include a second valve. The second valve may be biased to an open or a closed position. Preferably the second valve is biased to a closed position by a third biasing means.

The control means may be located upstream or downstream relative to the valve member. Preferably the control means is located upstream of the valve member. The control means may be actuated automatically in certain circumstances. For example, the control means may be actuated if the fluid supply reaches a predetermined pressure level, such as where the air supply of a diver is running low. The control means may be actuable by an operator to force the control means to the open position.

Each of the valve member, the valve seat and/or the percussive member may be isolated from the immediate environment of the signalling device such as where a diaphragm is adapted to transmit the sound through its wall to the external environment. Preferably, however, each of the valve member, the valve seat and/or the percussive member is in communication with the immediate environment of the signalling device.

BRIEF DESCRIPTION OF THE DRAWINGS

The invention shall be better understood from the following non-limiting description of an embodiment of the invention and the drawings, in which.

BEST MODE OF CARRYING OUT THE INVENTION

Figure 1:
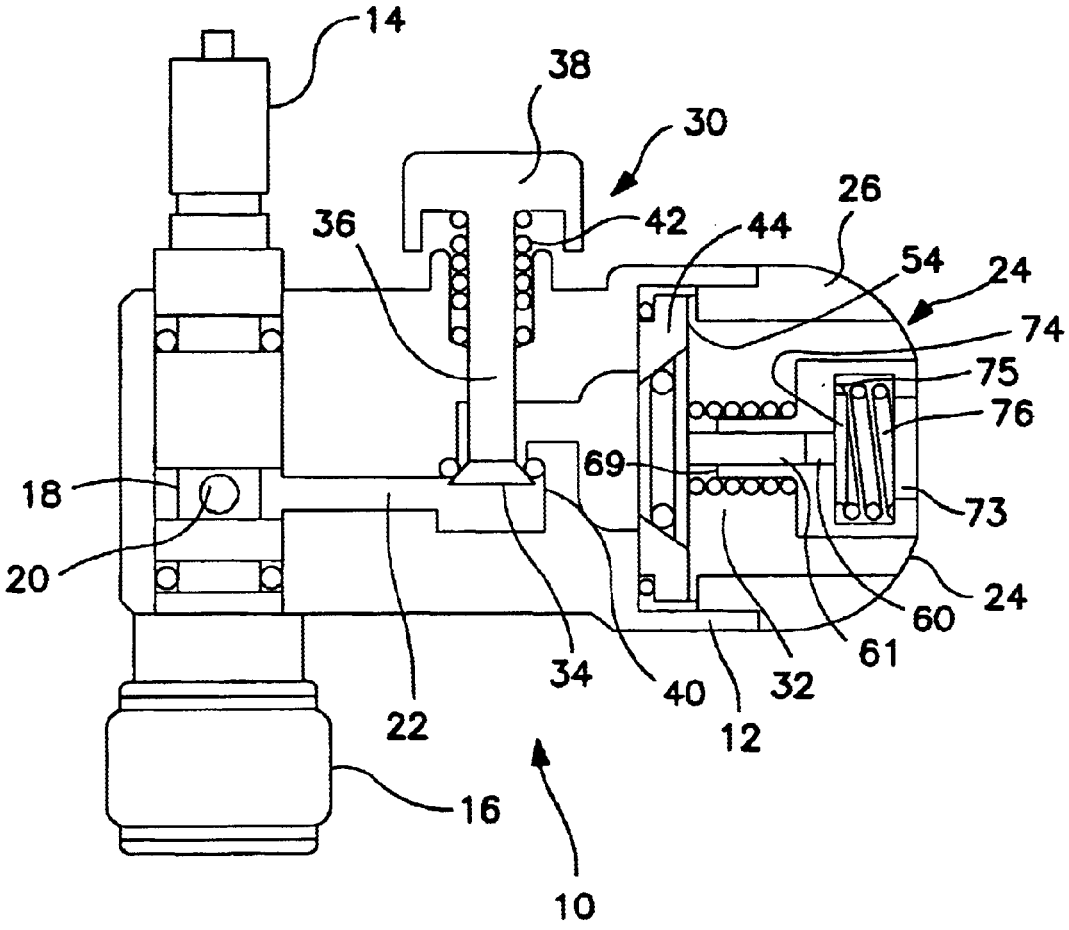
FIG. 1 shows a side cross-section of an embodiment of the invention in a "closed" position.

Referring to FIG. 1, the signalling device 10 comprises a housing 12 and an end cap 26. The signalling device is intended to be inserted in-line in a diver's air supply and so is provided with conventional male and female air line connectors 14 and 16 respectively. These connectors 14, 16 are connected by a tube 18 which extends through the housing 12. The tube 18 has one or more apertures 20 which feed air to a passageway 22 in the housing 12.

The passageway 22 exits to the environment via openings 24, which comprise a series of holes arranged in a circle, in end cap 26. Located between apertures 20 and openings 24 are two valve mechanisms, generally indicated by numerals 30 and 32. Intermediate the two valve mechanisms is a chamber 33.

The first valve mechanism, 30 is a simple, conventional, on-off valve which controls supply of pressurised fluid to the second valve mechanism 32. The valve 30 comprises valve member 34, plunger rod 36 and actuating button 38. Preferably the valve member 34 seats against an O-ring 40 and the actuating button 38 is biased by spring 42 to the closed position. Depressing actuating button 38 causes valve member 34 to move downwards, so allowing prescribed fluid to pass through the valve 30.

The second valve member 32 comprises a movable valve seat 44, a movable valve member 46 and biasing spring 48.

The movable valve seat 44 is circular and is positioned in an oversize bore 50 in housing 12. The end cap 26 screws or is a press fit into this bore 50 but has a flange 27 which contacts end 29 of housing 12 and so limits how far the end cap extends into the bore 50. The end cap 26 thus traps the valve seat within the bore, but allows the valve seat a limited amount of axial travel between annular surfaces 52 and 54. The valve seat 44 has an O-ring 56 on its upstream face which helps seal against annular surface 52 when in contact with it. However, this O-ring is not essential.

The valve seat 44 has a central bore 58, which diverges in the downstream direction. The valve member 46 is located downstream of the valve seat 44 and comprises a valve disc 62 and a rod 61. The valve member 46 is mounted on the end cap 26 via rod 61, which is received in a bore 60 in end cap 26. The rod 61 may reciprocate along bore 60.

The valve disc 62 has an annular edge surface 64 for engagement within the valve seat 44. As such the surface 64 is complimentary to bore 58 and diverges in the downstream direction. An O-ring 65 is provided in edge surface 64 to aid in sealing against valve seat 44, but is not essential. If desired the central bore 58 may be of constant diameter and the valve disc 46 may be of greater diameter than the central bore 58 and seal against the downstream face of the valve seat 44. In such circumstances an O-ring mounted on the upstream face of the disc 62 may be desirable.

The valve member 46 is biased toward the valve seat by spring 48, which is sandwiched between the downstream face 68 of valve disc 62 and an annular surface 70 on end cap 26.

The bore 60 in the end cap 26 is shorter than rod 61 and is open at both ends. At its upstream end the bore 60 receives the valve member 46 whilst at its downstream end it communicates with a chamber 72. This chamber is open to the environment via an opening 73. Located within this chamber 72 is a disc 74, biased toward the bore 60 against an annular surface 75 by a spring 76.

Figure 2:
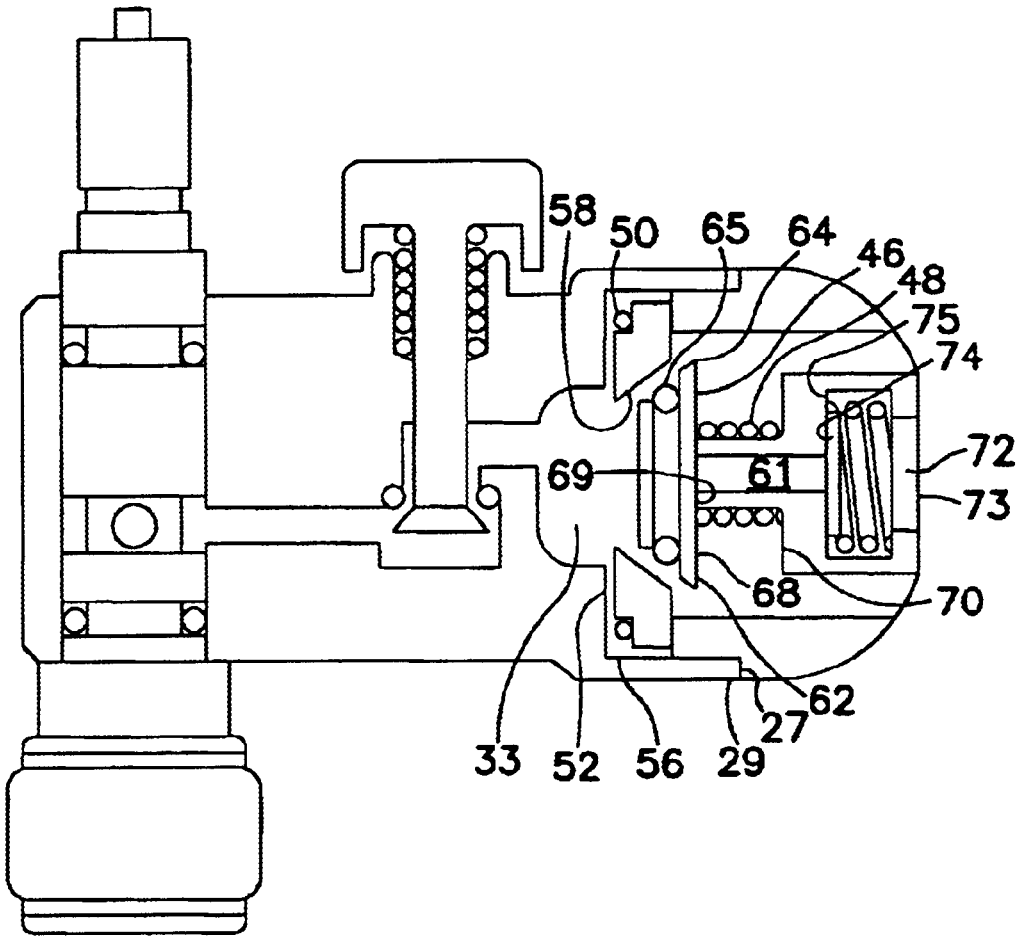
FIG. 2 shows the embodiment of FIG. 1 in the "open" position.

When the valve member 46 is fully retracted, i.e., the valve 32 is fully open, the downstream face 68 of the valve disc 62 contacts the face 69 of end cap 26, so preventing further downstream movement. The free end of the rod 61 is in contact with the disc 74 and has moved the disc 74 away from bore 60, against the biasing force of spring 76, as seen in FIG. 2.

In use, the valve 30 is normally closed, so no pressurised air is supplied to the valve 32 from the diver's air supply. As such spring 48 urges valve member 46 against the valve seat 44 and the valve seat against surface 52, as seen in FIG. 1.

When the actuator button 38 of valve 30 is depressed, compressed air flows into the chamber 33 upstream of the valve 32. Provided the pressure difference across the valve 32 is high enough, this overcomes the biasing force of the spring 48 and both the valve member 46 and the valve seat 44 move downstream. Valve seat 44 then hits annular surface 54, which generates sound which may escape to the environment via openings 24, as well as stopping further downstream movement of the valve seat. Valve member 46 continues to move downstream until the free end of rod 61 contacts disc 74, again generating sound which escapes to the environment via opening 73.

Further movement of the valve member 46 downstream under action of the pressure difference now occurs against the force of both the springs, 48 and 76 until the downstream face 68 of the valve disc 62 contacts face 69 of the end cap 26, again generating sound which also escapes to the environment via openings 24. At this point the valve member 46 cannot move downstream any more and the valve 32 is fully open.

The valve 30 tends to throttle the supply of air, even when fully open, whilst when valve 32 is fully open, there is little resistance to flow through the chamber 33, valve 32 and openings 24. As such when valve 32 is fully open the air pressure upstream of valve 32 in the chamber 33 decreases substantially and so the springs 48 and 76 exert a greater force on the valve member 46 than is exerted on it by the pressure difference across the valve member 46. Thus valve member 46 commences to move upstream toward the closed position. When the free end of rod 61 enters the bore 60, the disc 74 contacts annular surface 75, generating sound. Similarly when valve disc 62 contacts valve seat 44 and when valve seat 44 contacts annular surface 52, sound is also generated.

When valve 32 is fully closed, the pressure upstream of the valve 32 in chamber 33 increases again until the pressure difference across the valve 32 overcomes the force exerted by spring 48 and cycle repeats for as long as valve 30 remains open. This cycling occurs rapidly and so the impacts of the various components are relatively severe and so the sound generated is of suitable intensity.

As is apparent from the foregoing, in the preferred embodiment the sound is generated by the device from multiple sources as the valve 32 both opens and closes. Further there is no separate switching mechanism to cause reciprocation of the valve member 46. This also improves the sound generating efficiency of the device compared to existing devices.

It is to be appreciated that the movable valve seat 44 and the disc 74 are optional and not essential. Similarly the O-rings are not essential. If desired the invention may be reduced to a biased valve member sealing against a valve seat and in which the valve member opens and closes when a pressurised fluid is applied to the upstream side of the valve.

It will be apparent to those skilled in the art that many modifications and variations may be made to the embodiment described without departing from the spirit or scope of the invention.

What is claimed is:

1. A signalling device for attachment to a pressurised fluid source, said device including:

a housing having a passageway, at least in part, for communication with the fluid source;

a valve member located in the passageway and movable between a closed position in which it substantially blocks the passageway, and an open position in which fluid may flow through the passageway;

biasing means biasing the valve member towards the closed position, wherein the valve member reciprocates between the open and closed positions when a pressure difference above a set value exists on either side of the valve to produce a percussive sound;

wherein the valve member in the closed position seals the passageway by abutment against a valve seat, and the valve seat is movable between two positions.

2. The signalling device according to claim 1, wherein the valve seat is adapted to produce percussive sound upon arriving at each of the two positions.

3. The signalling device according to claim 1, wherein the valve seat is retained within a bore forming part of the passageway by means of internal retaining means against which the valve seat is adapted to strike to cause a percussive sound.

4. The signalling device according to claim 3, wherein the valve member is oriented axially within the passageway and contacts a portion of the housing when in the open position.

5. The signalling device according to claim 4, wherein the valve member includes a valve head and a rod extending therefrom.

6. The signalling device according to claim 5, wherein the valve head is adapted to contact the valve seat in the closed position and to contact a portion of the housing in the open position.

7. The signalling device according to claim 5, wherein the housing includes a second bore in which the rod is adapted to travel.

8. The signalling device according to claim 1, including a percussive member biased by a second biasing means towards the valve member.

9. The signalling device according to claim 8, wherein the valve member is adapted to strike the percussive member when moving to the open position.

10. The signalling device according to claim 9, wherein the percussive member is adapted to strike the housing when the valve member returns toward the closed position and the second biasing means urges the percussive member towards the valve member.

11. The signalling device according to claim 8, wherein the percussive member is in communication with the immediate environment surrounding the signalling device.

12. The signalling device according to claim 1, wherein the device includes control means for controlling the flow of fluid along the passageway from the pressurised fluid source.

13. The signalling device according to claim 12, wherein the control means includes a second valve biased to a closed position by a third biasing means.

14. The signalling device according to claim 12, wherein the control means is actuable by an operator to force the control means to the open position.

15. The signalling device according to claim 1, wherein the valve member is in communication with the immediate environment surrounding the signalling device.

16. The signalling device according to claim 1, wherein the valve seat is in communication with the immediate environment surrounding the signalling device.

17. A signalling device for attachment to a pressurised fluid source, said device including:

a housing having a passageway, at least in part, for communication with the fluid source;

a valve member located in the passageway and movable between a closed position in which it substantially blocks the passageway, and an open position in which fluid may flow through the passageway;

biasing means biasing the valve member towards the closed position, wherein the valve member reciprocates between the open and closed positions when a pressure difference above a set value exists on either side of the valve to produce a percussive sound;

wherein the valve member in the closed position seals the passageway by abutment against a valve seat, the valve seat is movable between two positions, and the device is for use under water.

* * * * *